US009200539B2

(12) United States Patent
Wilson et al.

(10) Patent No.: US 9,200,539 B2
(45) Date of Patent: Dec. 1, 2015

(54) TURBINE SHELL SUPPORT ARM

(75) Inventors: Bradley Edwin Wilson, Simpsonville, SC (US); Kenneth Damon Black, Travelers Rest, SC (US)

(73) Assignee: General Electric Company, Schenectady, NY (US)

( * ) Notice: Subject to any disclaimer, the term of this patent is extended or adjusted under 35 U.S.C. 154(b) by 663 days.

(21) Appl. No.: 13/547,146

(22) Filed: Jul. 12, 2012

(65) Prior Publication Data

US 2014/0017076 A1 Jan. 16, 2014

(51) Int. Cl.
*F01D 25/28* (2006.01)

(52) U.S. Cl.
CPC ..... *F01D 25/28* (2013.01)

(58) Field of Classification Search
CPC ..... F01D 25/28; F01D 25/26; F04D 29/522; F04D 29/644; F05D 2240/14
See application file for complete search history.

(56) References Cited

U.S. PATENT DOCUMENTS

| | | | | |
|---|---|---|---|---|
| 3,844,675 | A * | 10/1974 | Remberg | 415/108 |
| 5,435,694 | A | 7/1995 | Kray et al. | |
| 6,390,775 | B1 | 5/2002 | Paz | |
| 7,121,803 | B2 | 10/2006 | Gautreau et al. | |
| 7,229,245 | B2 | 6/2007 | Ellis et al. | |
| 7,419,361 | B1 | 9/2008 | Byam et al. | |
| 8,096,757 | B2 | 1/2012 | Snook et al. | |
| 2007/0128041 | A1* | 6/2007 | Ahmad et al. | 416/231 R |
| 2010/0226770 | A1 | 9/2010 | Frick et al. | |
| 2010/0275614 | A1* | 11/2010 | Fontaine et al. | 60/797 |
| 2011/0000222 | A1 | 1/2011 | Black et al. | |
| 2012/0009058 | A1 | 1/2012 | Floyd, II et al. | |
| 2012/0093639 | A1 | 4/2012 | Ballard, Jr. et al. | |

OTHER PUBLICATIONS

U.S. Appl. No. 13/208,829, filed Aug. 12, 2011, Casavant, et al.

* cited by examiner

*Primary Examiner* — Richard Edgar
*Assistant Examiner* — Juan G Flores
(74) *Attorney, Agent, or Firm* — Sutherland Asbill & Brennan LLP

(57) ABSTRACT

The present application and the resultant patent provide an example of a turbine casing. The turbine casing may include an outer shell, an inner shell, and a support arm supporting the inner shell within the outer shell. The inner shell and the support arm may include a scallop therein for reduced stress.

19 Claims, 2 Drawing Sheets

TURBINE SHELL SUPPORT ARM

TECHNICAL FIELD

The present application and the resultant patent relate generally to gas turbine engines and more particularly relate to a support arm for an inner turbine shell and the like with scalloped features so as to provide stress relief, particularly during transient operations.

BACKGROUND OF THE INVENTION

Generally described, industrial gas turbines and steam turbines may include a casing with an inner shell mounted to an outer shell. The inner shell may hold the shrouds and the nozzles. The inner shell may be split into two or more segments that may be joined or bolted together by flanges and the like to facilitate maintenance and repair. During transient operations, temperature changes in the turbine may produce axial and radial temperature gradients in the turbine shells and elsewhere. These temperature gradients may create large thermal stresses therein. Such stresses may have an impact on overall component lifetime.

For example, the inner turbine shell may be supported by a pair of shell arms. The shell arms support the weight of the inner shell and must accommodate the torque that results from the aerodynamic loads on the nozzle vanes during operation. The failure of a shell support arm could result in a catastrophic failure of the overall gas turbine engine. As such, at least a segment of the inner turbine shell must be replaced if cracks are found. Such repair procedures may be time consuming and costly.

There is thus a desire for an improved turbine casing. Such an improved turbine casing may adapt to thermal stresses and the like. Such a turbine casing may increase low cycle fatigue life for prolonged component operation with little additional costs.

SUMMARY OF THE INVENTION

The present application and the resultant patent thus provide a turbine casing. The turbine casing may include an outer shell, an inner shell, and a support arm supporting the inner shell within the outer shell. The inner shell and the support arm may include a scallop therein.

The present application and the resultant patent further provide a turbine casing. The turbine casing may include an outer shell, an inner shell, and a support arm supporting the inner shell within the outer shell. The support arm may include a filleted corner thereon. The inner shell may include a filleted slot therein adjacent to the support arm.

The present application and the resultant patent further provide a turbine casing. The turbine casing may include an outer shell, a number of inner shell segments, and a number of support arms supporting the inner shell segments within the outer shell. The support arms may include one or more filleted corners thereon. The inner shell segments may include one or more filleted slots adjacent to one or more of the support arms.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
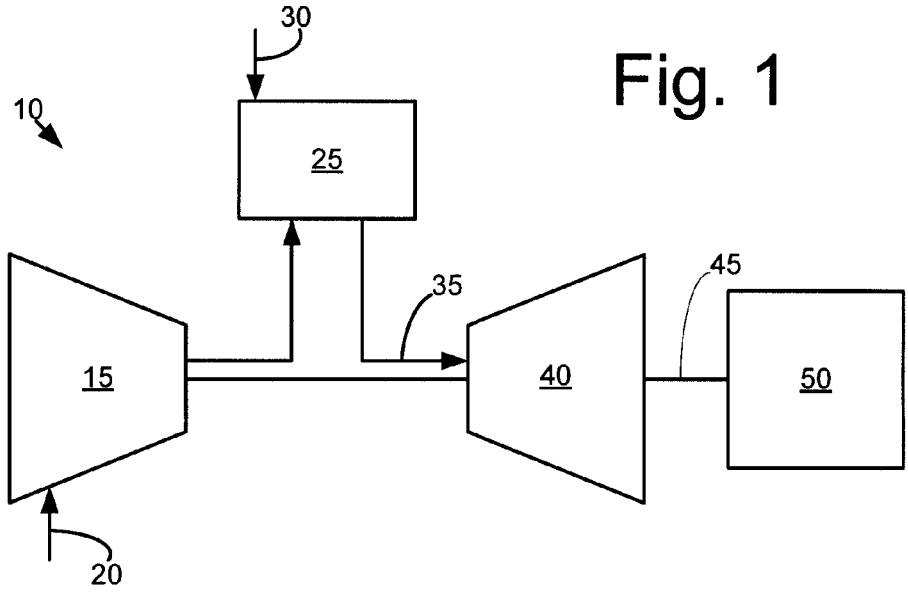
FIG. 1 is a schematic diagram of a gas turbine engine showing a compressor, a combustor, and a turbine.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
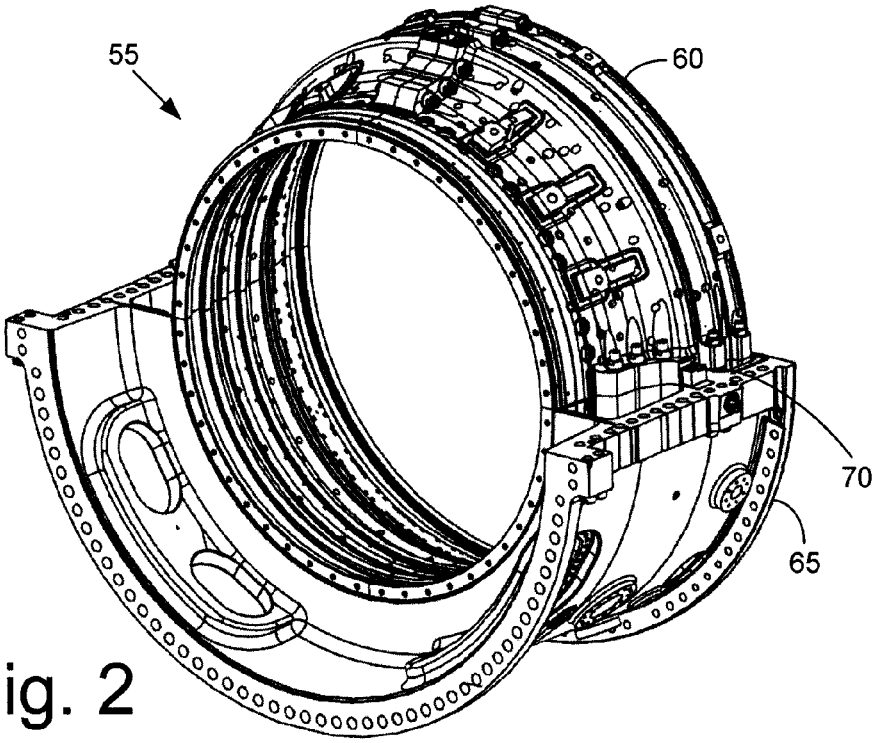
FIG. 2 is a perspective view of a turbine casing with an inner shell and a portion of an outer shell.

FIG. 2 shows an example of a portion of a turbine casing 55 that may be used with the turbine 40 and the like. The turbine casing 55 may include an inner shell 60 supported within an outer shell 65. Both the inner shell 60 and the outer shell 65 may be of unitary construction or either may be formed out of a number of sections and joined together. The turbine casing 55 as well as the inner shell 60 and the outer shell 65 therein may have any size, shape, or configuration.

Figure 3:
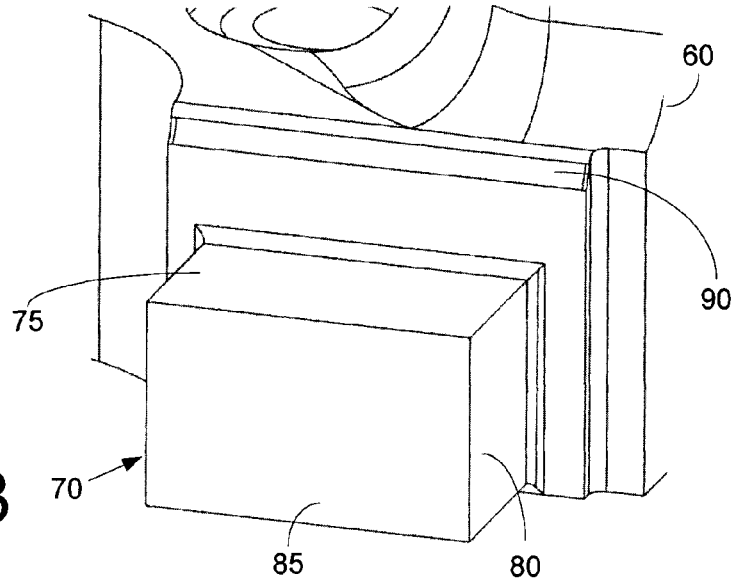
FIG. 3 is a perspective view of an inner shell support arm as may be used with the inner shell of FIG. 2.

The inner shell 60 may be supported within the outer shell 65 via a number of support arms 70. Any number of the support 70 may be used herein. As is shown in, for example, FIG. 3, the support arm 70 may include a number of horizontal surfaces or X-direction surfaces 75 and vertical surfaces or Y-direction surfaces 80 on the plane of the inner shell 60 and an outer surface or a Z-direction surface 85. The intersection of the surfaces 75, 80, 85 generally may result in a number of sharp corners 90, i.e., corners with about a ninety degree angle (90°) angle or so. These sharp corners 90 tend to develop large thermal stresses therein, particularly during transient operations. Such stresses may limit the overall cycle life of the casing 55 as a whole. The casing 55 and the components thereof may have many other shapes, sizes, and configurations.

Figure 4:
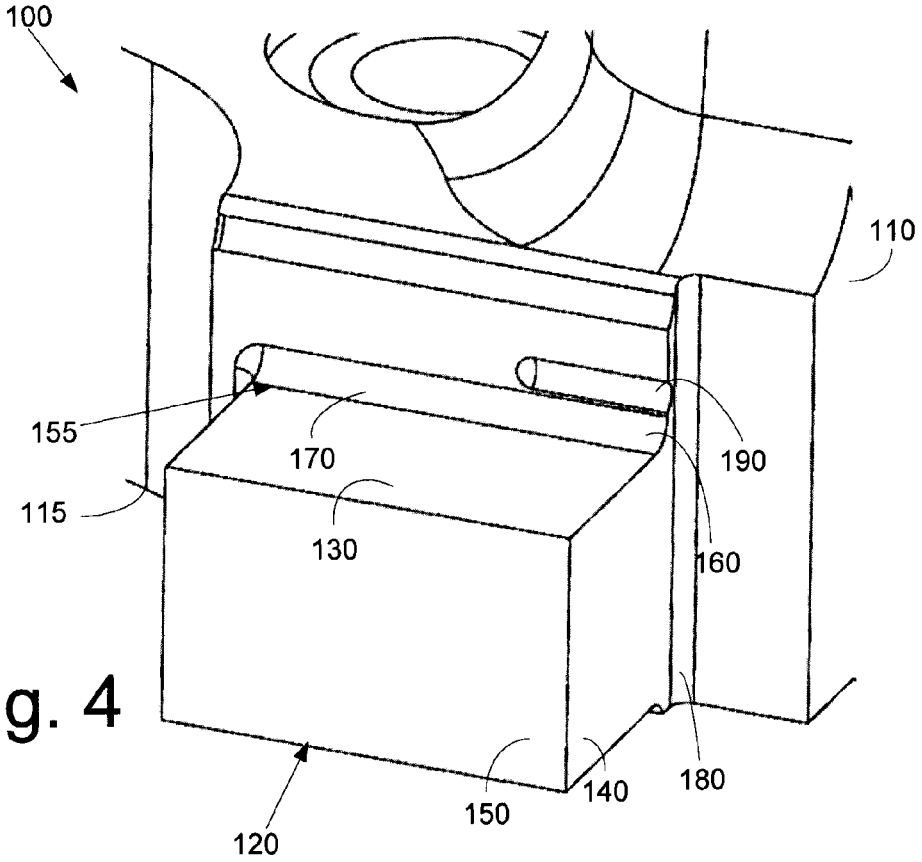
FIG. 4 is a perspective view of an inner shell with a support arm as may be described herein.

FIG. 4 shows a portion of a turbine casing 100 as may be described herein. The turbine casing 100 may include an inner shell 110 supported within an outer shell. An outer shell 65 similar to that described above and the like may be used herein. The inner shell 110 may be of unitary construction or the inner shell 110 may be made out of a number of segments 115. Any number of the segments 115 may be used herein and joined in a conventional fashion. The turbine casing 100 and the inner shell 110 may have any size, shape, or configuration.

The inner shell 110 may include a number of support arms 120. Any number of these support arms 120 may be used herein. The support arms 120 may be largely block-like in shape and may include a number of X-direction surfaces 130, a number of Y-direction surfaces 140, and a Z-direction surface 150. These directions are relative as opposed to indicating absolute positions. The size, shape, and configuration of the support arms 120 and the surfaces 130, 140, 150 may vary. The support arms 120 may be joined to the outer shell 65 in a conventional fashion.

Instead of the sharp corners 90 described above, the support arms 120 may have a number of cut-outs or scallops 155 formed therein. The scallops 155 may include a number of filleted corners 160. The filleted corners 160 may include an X-direction filleted corner 170 extending between the inner shell 110 and the X-direction surfaces 150 as well as a Y-direction filleted corner 180 extending between the inner shell 110 and the Y-direction surfaces 130. The scallops 155 of the filleted corners 160 may have any size, shape, and configuration. Moreover, the angle and depth of the scallops 155 may vary. Scallops 155 of varying configurations also may be used herein together. The scallops 155 may be cast within the inner shell 110 or otherwise formed therein according to other types of manufacturing techniques.

In addition to the filleted corners 160, the scallops 155 also may include a filleted slot 190. The filleted slot 190 may be positioned above the support arm 120 or elsewhere adjacent to the support arm 120 within the inner shell 110. The filleted slot 190 may extend along the entire length of the support arm 120 or, as shown, just a portion thereof. The size, shape, and configuration of the filleted slots 190 may vary. Moreover, the angle and depth of the filleted slots 190 may vary. Any number of the filleted slots 190 may be used herein. Other components and other configurations may be used herein.

The use of the scallops 155, either as the filleted corners 160 and/or as the filleted slots 190, thus may relieve thermal stresses about the support arms 120 during transient operations and the like. The fillet corners 160 and the filleted slots 190 move high stresses away from the corners and other areas of stress concentrations. Specifically, the scallops 155 of the filleted corners 160 and the filleted slots 190 act as a shield for large surface circumferential and axial thermal stresses. Moreover, the stresses may be spread out so as to lower the overall maximum stress. As such, the risk of cracking may be reduced. The strain range thus may be reduced so as to increase low cycle fatigue life with a resultant increase in overall component lifetime. The use of the scallops 155 herein may significantly increase the predicted number of cycles to crack initiation.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A turbine casing, comprising:
an outer shell;
an inner shell; and
a support arm supporting the inner shell within the outer shell;
the inner shell and the support arm comprising a scallop therein;
wherein:
the support arm comprises a filleted corner at an interface between the support arm and the inner shell; and
the inner shell comprises a filleted slot defined therein, the filleted slot positioned adjacent to the filleted corner of the support arm.

2. The turbine casing of claim 1, wherein the support arm comprises an X-direction surface and wherein the filleted corner comprises an X-direction filleted corner with the scallop.

3. The turbine casing of claim 1, wherein the support arm comprises a Y-direction surface and wherein the filleted corner comprises a Y-direction filleted corner with the scallop.

4. The turbine casing of claim 1, wherein the support arm comprises a plurality of X-direction surfaces with an X-direction filleted corner and a plurality of Y-direction surfaces with a Y-direction filleted corner.

5. The turbine casing of claim 4, wherein the support arm comprises a Z-direction surface.

6. The turbine casing of claim 1, wherein the filleted slot extends along the support arm in whole or in part.

7. The turbine casing of claim 1, wherein the inner shell comprises a plurality of segments.

8. The turbine casing of claim 1, wherein the inner shell comprises a plurality of support arms.

9. The turbine casing of claim 1, wherein the support arm comprises a plurality of scallops therein.

10. The turbine casing of claim 1, wherein the inner shell and the support arm comprise a plurality of scallops therein.

11. The turbine casing of claim 10, wherein the plurality of scallops comprises one or more filleted corners and one or more filleted slots.

12. The turbine casing of claim 1, wherein the scallop is cast within the inner shell.

13. The turbine casing of claim 1 wherein:
the filleted slot has a first length;
the filleted corner has a second length; and
the first length is less than the second length.

14. A turbine casing, comprising:
an outer shell;
an inner shell; and
a support arm supporting the inner shell within the outer shell;
the support arm comprising a filleted corner; and the inner shell comprising a filleted slot adjacent to the support arm;
wherein the support arm comprises an X-direction surface with an X-direction filleted corner and a Y-direction surface with a Y-direction filleted corner; and
the X-direction surface is perpendicular to the Y-direction surface, such that the X-direction filleted corner is perpendicular to the Y-direction filleted corner.

15. The turbine casing of claim 14, wherein the support arm comprises an X-direction surface and wherein the filleted corner comprises an X-direction filleted corner.

16. The turbine casing of claim 14, wherein the support arm comprises a Y-direction surface and wherein the filleted corner comprises a Y-direction filleted corner.

17. The turbine casing of claim 14, wherein the support arm comprises a plurality of X-direction surfaces and a plurality of Y-direction surfaces.

18. The turbine casing of claim 14, wherein the filleted slot extends along the support arm in whole or in part.

19. A turbine casing, comprising:

an outer shell;

a plurality of inner shell segments;

a plurality of support arms supporting the plurality of inner shell segments within the outer shell;

the plurality of support arms comprising one or more filleted corners; and the plurality of inner shell segments comprising one or more filleted slots adjacent to the one or more filleted corners, wherein the one or more filleted slots have a slot length equal to a corner length of the one or more filleted corners.

* * * * *